US005557840A

United States Patent [19]

Terpening

[11] Patent Number: 5,557,840

[45] Date of Patent: Sep. 24, 1996

[54] TUBE SHEET LOCATOR AND TUBE EXPANDER

[75] Inventor: John P. Terpening, Syracuse, N.Y.

[73] Assignee: J. E. Miller Inc., E. Syracuse, N.Y.

[21] Appl. No.: 387,080

[22] Filed: Feb. 13, 1995

[51] Int. Cl.[6] ..... B23P 15/26

[52] U.S. Cl. ..... 29/727; 29/723; 29/890.047

[58] Field of Search ..... 29/726, 727, 723, 29/523, 890.047

[56] References Cited

U.S. PATENT DOCUMENTS

| | | | |
|---|---|---|---|
| 4,850,101 | 7/1989 | McDonough et al. | 29/523 |
| 4,858,296 | 8/1989 | Gray | 29/727 |
| 4,876,871 | 10/1989 | Arzenti et al. | 29/727 |
| 4,901,551 | 2/1990 | Widart | 29/523 |
| 4,976,027 | 12/1990 | Cartry et al. | 29/723 |
| 5,008,996 | 4/1991 | Bonnand et al. | 29/727 |
| 5,040,405 | 8/1991 | Honma et al. | 72/462 |
| 5,129,246 | 7/1992 | Strickland et al. | 29/727 |
| 5,442,858 | 8/1995 | Vetter | 29/890.047 |
| 5,479,699 | 1/1996 | Synder | 29/727 |

*Primary Examiner*—Irene Cuda
*Attorney, Agent, or Firm*—Charles S. McGuire

[57] ABSTRACT

Apparatus for localized radial expansion of a ductile metal tube into tight engagement with a tube support sheet, e.g., for deformable member which is axially compressed by hydraulic pressure to effect radial expansion of the deformable member and the tube. The hydraulic pressure is multiplied to provide a relatively high force in a small diameter by connecting a plurality of pistons in series by rigid connecting rods having axial and radial bores for flow of pressurized fluid. The apparatus carries a probe for locating the position of the tube support sheet and a support member carrying an eccentric cam. Rotation by an operator of the support member, by rotation of a rod passing therethrough, causes the cam to frictionally engage the tube wall and wedge the support member in position to provide an abutment surface for contact by a stop member on the rod, thereby positioning the deformable member at the desired axial location to effect radial expansion of the tube.

21 Claims, 2 Drawing Sheets

TUBE SHEET LOCATOR AND TUBE EXPANDER

BACKGROUND OF THE INVENTION

The present invention relates to apparatus for locally expanding ductile tubes of a heat-exchanger into fixed engagement with a supporting metal sheet having openings through which the tubes pass in laterally spaced parallel relation. The invention further relates to means for locating the position of a tube sheet with a probe positioned inside a tube passing through the sheet and for expanding the tube at the precise location where it passes through the sheet as part of the same operation, i.e., without withdrawing the probe from the tube.

In a common form of heat exchange apparatus such as condensers and evaporators in a variety of refrigeration units, a plurality of hollow tubes pass through openings in an essentially planar support sheet. Typically, a plurality of such sheets are provided at spaced intervals along the length of the tubes. Although the tubes are closely surrounded by the openings when axially inserted therethrough, it is necessary to form a tight, mechanical connection between the outer surfaces of the tubes and the portions of the sheet surrounding the openings, in order to eliminate tube vibration and resulting wear.

Since both the tubes and sheets, in order to provide efficient heat conduction, are normally formed of ductile metal, the connection is provided by expanding the tubes with an internal expansion device in the areas where they pass through the openings. It is necessary, of course, to position the expansion device at a predetermined location within the tube to ensure that expansion is effected in the plane of the support sheet. Thus, fabrication of heat exchange apparatus involving controlled expansion of a relatively large number of tubes at several axial locations can be a time-consuming task, requiring a skilled operator, representing a significant portion of the cost of such apparatus.

The principal object of the present invention is to provide apparatus for improving the efficiency, and thus reducing the cost, of fabricating heat exchange devices wherein hollow, elongated tubes are expanded into tight engagement with support sheets.

Another object is to provide novel and improved apparatus for effecting localized, radial expansion of a hollow, elongated tube of ductile metal at a desired axial location.

Other objects will in part be obvious and will in part appear hereinafter.

SUMMARY OF THE INVENTION

A hydraulic pump is connected by a flexible hose to axially adjacent sections of steel tubing forming hydraulic cylinders for a plurality of pistons connected in series by rigid rods. The rod of the forwardmost piston extends past the end of the steel tubing, through an opening in a compressible member and is connected to a rigid member of the same outside diameter as the steel tubing. The compressible member is positioned between the forward end of the steel tubing and the rigid member and is radially expanded as it is compressed by rearward movement of the pistons and the rigid member in response to hydraulic pressure delivered by the pump and multiplied by the number of pistons employed.

An elongated rod is attached to and extends forwardly from the rigid member slidingly through a central opening in a cam support member, to a fixed stop member at its forward end. An eccentric cam element encircles and is rotatably slidable axially through the opening in the cam support member, rotation of the rod is transmitted to the support member. A conventional, metal detecting probe is carried rearwardly of the hydraulic cylinders and connected by electrical leads extending through the hose to an external control box.

In operation, the elongated rod and steel tubing forming the hydraulic cylinders are advanced into a heat exchanger tube which extends through openings in one or more metal support sheets. The cam support member is placed at its rearward most position upon the elongated rod; that is, the front end of the support member is spaced as far as possible from the stop member at the forward end of the rod. As the operator advances the apparatus into the tube, indicating means on the control box provide a visual read-out showing that the probe is at a position where the tube passes through an opening in a support sheet.

With the apparatus in this axial position, the operator rotates the flexible hose, thereby rotating the steel tubing forming the hydraulic cylinders and the elongated rod attached thereto, as well as the cam support member. The outer surface of the cam fits rather closely within and frictionally engages the inside surface of the heat exchanger tube. Thus, the support member rotates within the cam and, due to the eccentric relation of the cam surface to the rotational axis of the support member, is frictionally wedged in its axial position in the tube.

The operator then pulls the apparatus rearwardly in the tube, with the cam and support member remaining stationary as the elongated rod slides through the support member until the latter is contacted by the stop member. Relative dimensions are such that, in this position, the compressible member is positioned within the tube adjacent the opening in the tube support sheet. The pump is then activated to cause the hydraulic cylinders to exert a force squeezing the compressible member between the end of the forward most cylinder and the rigid member on the end of the forwardmost piston rod. The compressible member is thereby expanded with a force sufficient to expand the tube into tight frictional engagement with the portion of the support sheet surrounding the opening through which the tube passes. The operation is repeated for each tube at each tube support sheet.

The foregoing features of construction and operation of the apparatus of the invention will be fore readily understood and fully appreciated from the following detailed disclosure, taken in conjunction with the accompanying drawings.

DETAILED DESCRIPTION

Figure 1:
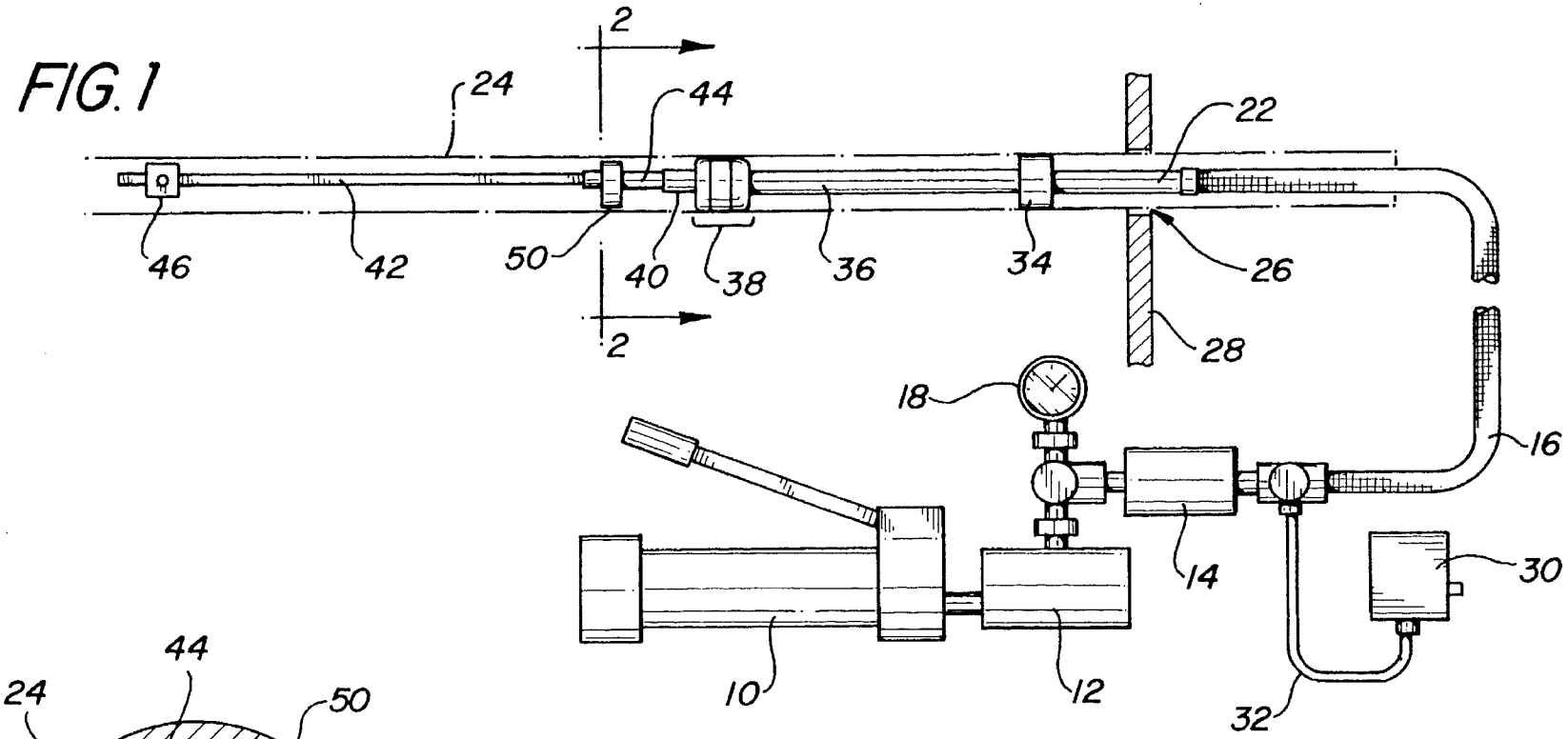
FIG. 1 is a somewhat diagrammatic illustration of the apparatus of the invention.

Referring now to the drawings, in FIG. 1 is shown conventional hydraulic pump 10, connected through relief valve 12 and coupling 14, to flexible hose 16 with gauge 18 providing in the usual manner a visual indication of the fluid pressure delivered by pump 10. Hose 16 is connected at its other end 20 to section 22, constituting the proximal end of that portion of the apparatus which is moved axially into and out of heat exchanger tubes. A portion of one such tube is shown in phantom lines, surrounding the apparatus positioned therein and denoted by reference numeral 24.

In the conventional manner of fabrication of certain types of heat exchange apparatus, or of replacing tubes thereof, a plurality of tubes designed to carry a heat exchange fluid are supported in spaced, parallel relation by metal sheets having openings through which the tubes pass. The support sheets are essentially planar and perpendicular to the parallel axes of the tubes, the latter being locally expanded into tight engagement with the portion of the support sheet surrounding the opening. In FIG. 1, tube 24 extends through opening 26 in support sheet 28, the tube having not yet been expanded into engagement with the sheet.

Section 22 of the hydraulic conduit comprises or incorporates an electronic probe of commercially available form which generates a signal commensurate with the probe's proximity to magnetically permeable metals. The probe is effective when used with the usual copper, or other nonferrous tubes to generate an electrical signal when positioned within a tube adjacent a support sheet. Control box 30, carrying the probe power supply, circuitry and visual readout, is connected by electrical cable 32 to the proximal end of hose 16 and by leads extending through the hose to the probe at section 22. Thus, a visual indication is provided at control box 30 telling the operator when the probe is positioned adjacent a support sheet. Conventional apparatus of this type is capable of locating the probe relative to the support sheet with accuracy to within 0.020" in a direction axially of tube 24.

Cylindrical spacer 34, of teflon or other low-friction material, has a diameter substantially equal to the inside diameter of tube 24 and is positioned forwardly of the probe to support this portion of the apparatus relative to the tube. Spacer 34 ensures that the probe is positioned to one side of the tube, thus providing a consistent output signal regardless of the probe's orientation. Section 36 of the apparatus, extending forwardly from spacer 34, is made up of a plurality of series-connected hydraulic cylinders which will be more fully described later herein. The piston rod of the forwardmost of these cylinders extends through central openings in a plurality of so-called expansion tips which collectively form what is termed compressible member 38 and is attached at its distal end to rigid member 40. Elongated rod 42 is attached to and extends forwardly from rigid member 40, through an opening in cam support member 44, and is attached to stop member 46 at or near the distal end of rod 42.

Figure 2:
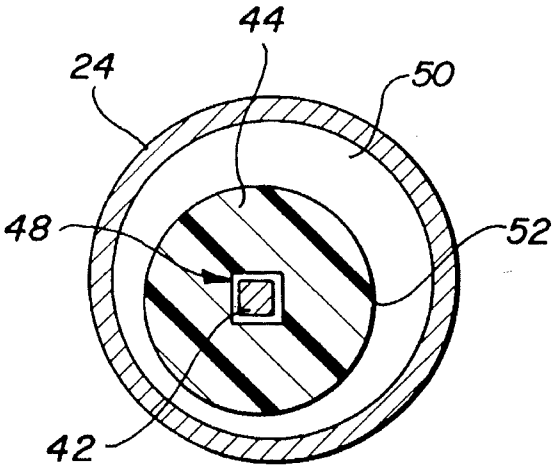
FIG. 2 is an end elevational view, in section on the line 2—2 of FIG. 1, showing a portion of the apparatus in an operative position within a heat exchanger tube.

As will be noted from FIG. 2, rod 42 is square in cross section, as is opening 48 in support member 44. The opening is slightly larger than the cross section of rod 42, allowing the rod to slide freely through support member 44 in an axial direction while being capable of transmitting rotational movement thereto. Cam member 50 has a cylindrical outer surface of substantially the same diameter as the inside diameter of tube 24, the cam member being of a material which exhibits some degree of frictional resistance opposing movement with respect to the tube wall.

Cam member 50 has a circular opening with a central axis laterally offset a small distance from the axis of its outer surface, giving the cam member some degree of eccentricity. The diameter of the opening, i.e., the inside diameter of the cam member, is substantially equal to that of a reduced diameter portion 52 of cylindrical cam support member 44 which is loosely encircled by cam 50. Preferably, cam 50 is of a somewhat flexible material and is split to permit mounting upon support member 44.

In operation, the probe is activated by means of a switch on control box 30. The distal end of the apparatus is inserted into the tube to be expanded and the operator manually advances the apparatus into the tube. When the indicating means on control box 30 shows that the probe is positioned adjacent tube support sheet 28, advancement of the apparatus is stopped and the operator manually rotates the apparatus, grasping the portion thereof or hose 16 outside tube 24. Since all portions of the apparatus except cam support member 44 and cam 50 are rigidly connected, rod 42 is rotated and, due to the square cross sections of the rod and opening 48, the rotation is transmitted to support member 44.

Cam 50 does not rotate, or at least does not rotate to the extent of support member 44, due to the frictional drag of the outer surface of cam 50 on the inner surface of tube 24. Due to the offset of the coaxial axes of rod 42, support member 44 and the opening in cam 50 from the coaxial axes of the outer surface of cam 50 and tube 24, i.e., due to eccentricity of the cam, the aforesaid rotation serves to wedge support member 44 against cam 50. Thus, support member 44 is frictionally restrained from axial movement with respect to tube 24. The amount of rotation required to effect the described frictional restraint of support member 44 is normally not more than about ½ turn.

It should be noted that as the apparatus is advanced into tube 24, the rearward or proximal end of support member 44 is engaged against the forward, distal side of rigid member 40 or another portion affixed thereto. This relationship is maintained as the apparatus is advanced due to the frictional drag of cam 50 on the inner surface of tube 24. The axial distance from the probe to compressible member 38 is the same as the distance from the forward, distal end of support member 44 to the rearward, proximal surface of stop member 46. In order to provide precise control of the latter distance, it is preferred that the axial position of stop member 46 on rod 42 be adjustable, e.g., by set screws or other such means.

With support member 44 at a releasably fixed axial position in tube 24, the operator pulls the apparatus-rearwardly, i.e., in a direction withdrawing it from the tube, with rod 42 sliding axially through opening 48 in the stationary support member 44. Such movement is continued until stop member 46 contacts the forward end of support member 44, which thus serves as an abutment surface within tube 24. As a consequence of the aforesaid axial distances, compressible member 38 is now n the position occupied by the probe prior to rearward movement of the apparatus. Thus, forcible expansion of compressible member 38 will produce localized expansion of tube 24 into tight frictional engagement with the portion of tube support sheet 28 surrounding opening 26.

Figure 3:
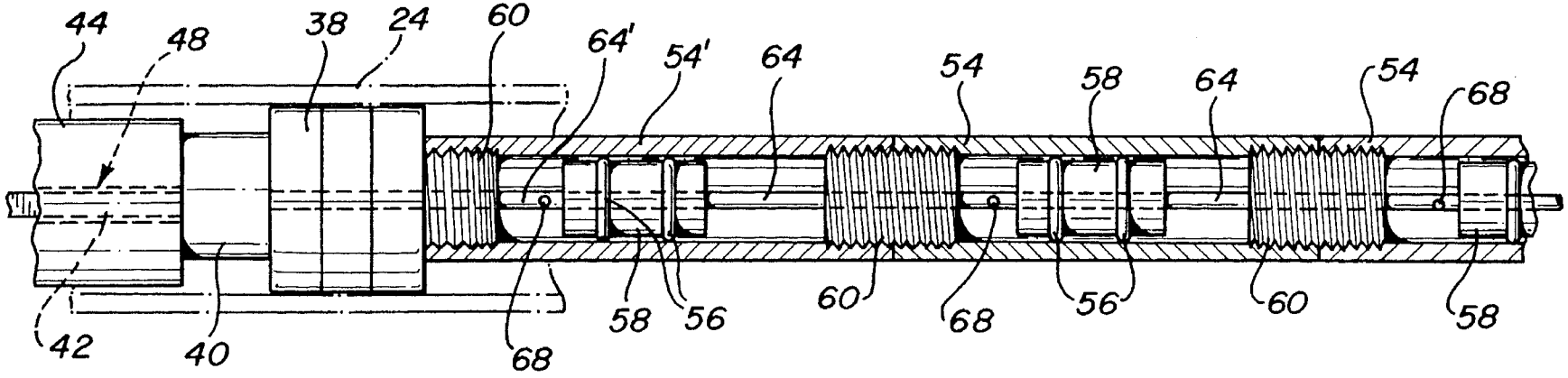
FIG. 3 is a front elevational view, also in section, of other portions of the apparatus, shown in a first position.

Referring now to FIG. 3, an operative form of apparatus for converting the hydraulic fluid pressure delivered by pump 10 to the force required for expanding tube 24 is illustrated. A plurality of individual cylinders 54 are formed from steel tubing of appropriate inside and outside diameter and length. Cylinders 54 are internally threaded from each end for a portion of their length and the internal surface between the threaded portions is lapped to provide hydraulically sealed contact with rings 56 on moveable pistons 58.

Each of cylinders 54 is firmly connected to axially adjacent cylinders by threaded engagement of opposite, externally threaded ends of connecting members 60 with the internal threads in abutting ends of the cylinders. Connecting rods 64 are each threaded from both ends for a portion of their length and the outer surface between the threaded portions is polished. Each of connecting rods 64 has a through, axial bore 66 and a radial bore 68 communicating at one side of the rod with the axial bore. Each of pistons 58 has an internally threaded, through axial bore 70 and, as previously indicated, carries a pair of piston rings 56 for hydraulically sealing, slidable engagement with the inside walls of cylinders 54.

Connecting rods 64 are threadedly engaged with the internal threads of successive pistons 58, between which they pass through rings 72 carried in internal, annular recesses in connecting members 60. The forwardmost of the connecting rods, indicated by reference numeral 64', extends through central openings in the expansion tips forming compressible member 38 and is affixed at its forward end to rigid member 40.

Compressible member 38, of rubber or rubberlike material of appropriate hardness and other characteristics, is positioned between the forward, distal end of forwardmost cylinder 54' and rigid member 40. Prior to actuation of pump 10, i.e., without application of hydraulic pressure, the elements are positioned as shown in FIG. 3, with each of radial openings 68 positioned between one of pistons 58 and connecting members 60. Hydraulic fluid passes through axial and radial openings 66 and 68, respectively, in each of connecting rods 64 into the spaces between each pair of adjacent pistons 58 and connecting members 60. Since the connecting members are stationary, fluid pressure acts upon the forward sides of pistons 58, urging them in a rearward direction, i.e., toward the right seen in FIG. 3.

Figure 4:
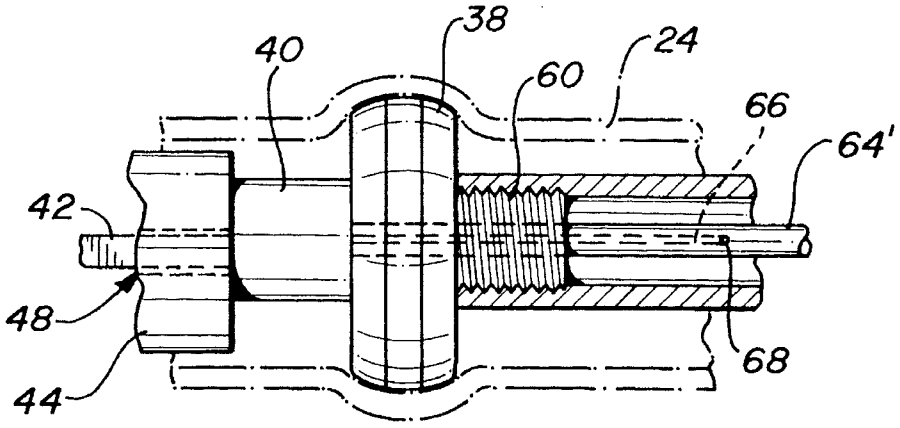
FIG. 4 is a fragment of FIG. 3, showing certain moveable portions in a second position.

The hydraulic pressure delivered by pump 10 is applied simultaneously to all of pistons 58 and, due to the rigid, series connections of the pistons, the rearward force applied by forwardmost connecting rod 64' to rigid member 40 is the hydraulic pressure delivered by pump 10 multiplied by the total of the areas of pistons 58 to which such pressure is applied. This force is sufficient to axially compress or squeeze compressible member 38 between the forward end of the forwardmost of cylinders 54 and the rear side of rigid member 40 to extent causing radial expansion of tube 24 into tight engagement with the surrounding portion of support sheet 28, as shown in FIG. 4.

After localized expansion of tube 24 is completed, pump 10 is deactivated, removing hydraulic pressure, permitting compressible member 38 to expand to its normal configuration and the other elements returning to their positions of FIG. 3. Although cam support member 44 is frictionally wedged in position within tube 24, only a very small portion of the force delivered by the forwardmost piston rod is required to overcome this frictional engagement and move member 44 a short distance within the tube as the latter is expanded. After hydraulic pressure is released, the operator rotates hose 16 and the elements connected thereto by a small amount, sufficient to release the wedging of support member 44 against cam 50 and permit free axial movement of the apparatus within the tube. The apparatus is then advanced to bring the probe to a position adjacent the next support sheet or withdrawn from tube 24 and advanced into a different heat exchanger tube.

From the foregoing it may be seen that the objects and advantages of the invention are realized by the disclosed apparatus and the method of its employment. The relatively high force, concentrated in a small diameter necessary to effect the desired tube expansion is achieved through the use of a plurality of series-connected hydraulic cylinders and pistons, the number of which is selected to fit the needs of the intended application. Other variations in size, type, relative arrangement, etc., of the various disclosed elements of apparatus and methods of employment are possible within the scope of the invention, as defined by the following claims.

What is claimed is:

1. Apparatus for effecting localized, radial expansion of ductile metal tubes of a heat exchange device into tight engagement with a tube support sheet, said apparatus comprising:

a) a cylinder having a diameter smaller than the diameter of said tubes, whereby said cylinder may be freely moved axially into and out of said tubes;

b) a plurality of pistons arranged in axially spaced relation to one another within said cylinder in hydraulically sealed relation thereto, each of said pistons having a surface to which a predetermined fluid pressure is applied to effect movement of said pistons in a first direction axially of said cylinder;

c) a plurality of connecting rods, each extending between and fixedly connected at opposite ends to a successive pair of said pistons, whereby all of said pistons are rigidly connected in series and are moved in said first direction with a total force equal to said predetermined pressure multiplied by the total area of said piston surfaces;

d) a deformable member positioned within said tube, outside said cylinder, said member being radially expandable in response to axial compression, and returning to its original configuration upon removal of said axial compression; and e) means for translating said total force from said pistons to said axial compression, the magnitude of said total force being sufficient to radially expand said deformable member by an amount effecting said radial expansion of said tube.

2. The apparatus of claim 1 wherein said translating means comprise first and second, spaced surface portions, relatively moveable toward and away from one another, said deformable member being positioned between said first and second surface portions for axial compression in response to movement of said surface portions relatively toward one another.

3. The apparatus of claim 2 wherein said first surface portion comprises an end of said cylinder and said second surface portion is connected to and moveable by said pistons.

4. The apparatus of claim 3 wherein said second surface portion comprises a surface of a rigid member connected to an endmost of said pistons by a rod extending through an opening in said deformable member.

5. The apparatus of claim 1 and further including a plurality of fluid sealing means within and fixed with respect to said cylinder, one of said sealing means being positioned between each pair of said pistons, said connecting rods extending slidably through said sealing means in sealed engagement therewith.

6. The apparatus of claim 5 wherein said cylinder comprises a plurality of axially adjacent sections successively connected to one another by portions of said sealing means.

7. The apparatus of claim 6 wherein each of said connecting rods includes a through, axial bore and a radial bore through which said axial bore communicates with the space between one of said pistons and one of said sealing means.

8. Apparatus for axial movement into and out of an elongated tube of ductile metal and for effecting localized radial expansion of said tube in a predetermined axial region, said apparatus comprising:

a) signal generating means for providing a signal perceptible by an operator in response to the positioning of said signal generating means within said tube radially adjacent said predetermined axial region;

b) deformable means for selective, radially outward movement with a force and magnitude sufficient to effect said radial expansion of said tube in response to actuation by an operator; and c) means connecting said signal generating means to said deformable means.

9. The apparatus of claim 8 and further including stop means for limiting the extent of axial movement of said apparatus within said tube from a first to a second position.

10. The apparatus of claim 9 wherein said extent of axial movement is substantially equal to the distance between said signal generating means and said deformable means.

11. The apparatus of claim 7 wherein said radially outward movement of said deformable means is effected in response to axial compression of said deformable means.

12. The apparatus of claim 11 wherein said axial compression is effected by hydraulic pressure generated in response to said actuation by an operator.

13. The apparatus of claim 7 wherein said apparatus is elongated along an axis, said generating means and said deformable means being spaced from one another along said axis by a predetermined distance.

14. The apparatus of claim 13 and further including stop means having a first portion selectively moveable by an operator between engaged and disengaged positions, and a second portion in fixed axial relation to said generating and deformable means, said second portion when engaged providing an abutment surface for contact by said second portion to limit axial movement of said apparatus within said tube.

15. The apparatus of claim 14 and further including an elongated rod fixedly attached with respect to said signal generating and deformable means and extending along said axis, said second portion of said stop means being fixedly attached to said rod.

16. The apparatus of claim 15 wherein said first portion of said stop means comprises a cam member and a cam support member, said cam member surrounding said support member for rotation with respect thereto and said support member having an opening through which said rod slidingly passes for axial movement with respect to said support member.

17. Apparatus having a longitudinal axis for insertion into and withdrawal from a hollow, metal tube to effect localized, radial expansion of said tube at a predetermined axial position, said apparatus comprising:

a) a resiliently deformable member radially expandable from an undeformed configuration in response to axial compression, said deformable member returning to said undeformed configuration upon removal of said axial compression;

b) means releasably engageable with said tube for positioning said deformable member at said predetermined axial position within said tube; and c) actuating means for selectively effecting and removing said axial compression.

18. The apparatus of claim 17 wherein said releasably engageable means comprises cam means.

19. The apparatus of claim 18 wherein said cam means comprises means moveable by operator actuation into and out of frictional engagement with the surface of said tube.

20. The apparatus of claim 19 wherein said operator actuation comprise manual rotation of at least a portion of said apparatus.

21. The apparatus of claim 20 wherein said cam means comprise an annular cam member surrounding a cam support member for rotation with respect thereto and said apparatus includes an elongated rod rotatably connected to said cam support member and axially moveable with respect thereto.

* * * * *